US007490384B2

(12) United States Patent
Lee

(10) Patent No.: US 7,490,384 B2
(45) Date of Patent: Feb. 17, 2009

(54) DOOR HINGE APPARATUS OF REFRIGERATOR

(75) Inventor: Chang-Lim Lee, Gyeongsangnam-Do (KR)

(73) Assignee: LG Electronics Inc., Seoul (KR)

( * ) Notice: Subject to any disclaimer, the term of this patent is extended or adjusted under 35 U.S.C. 154(b) by 303 days.

(21) Appl. No.: 11/133,303

(22) Filed: May 20, 2005

(65) Prior Publication Data

US 2005/0262663 A1 Dec. 1, 2005

(30) Foreign Application Priority Data

May 27, 2004 (KR) ..... 10-2004-0037815

(51) Int. Cl.
*E05D 7/04* (2006.01)

(52) U.S. Cl. ..... 16/244; 16/235; 16/319

(58) Field of Classification Search ..... 16/32, 16/221, 235, 244, 242, 243, 229, 380, 381, 16/240, 232, 241, 319, 353, 374, 375, 19, 16/300, 301; 411/27, 49

See application file for complete search history.

(56) References Cited

U.S. PATENT DOCUMENTS

| | | | | | |
|---|---|---|---|---|---|
| 1,345,294 | A * | 6/1920 | Van Meter | 16/19 |
| 1,423,700 | A * | 7/1922 | Van Meter | 16/19 |
| 2,206,755 | A * | 7/1940 | Schweller | 16/244 |
| 3,592,257 | A * | 7/1971 | Matyas | 160/186 |
| 4,106,158 | A * | 8/1978 | Kellems et al. | 16/238 |
| 4,151,681 | A * | 5/1979 | Roberts | 49/382 |
| 4,677,707 | A * | 7/1987 | Holler | 16/239 |
| 4,864,691 | A * | 9/1989 | Gidseg et al. | 16/312 |
| 4,932,729 | A * | 6/1990 | Thompson et al. | 312/405 |
| 5,333,355 | A * | 8/1994 | Beswick et al. | 16/300 |
| 5,495,639 | A * | 3/1996 | Wartian | 16/79 |
| 5,568,673 | A * | 10/1996 | Ryczek | 16/244 |
| 6,978,516 | B1 * | 12/2005 | Calderon et al. | 16/235 |
| 7,111,363 | B2 * | 9/2006 | Lee et al. | 16/376 |
| 2006/0143860 | A1 * | 7/2006 | Park et al. | 16/243 |

FOREIGN PATENT DOCUMENTS

| | | | |
|---|---|---|---|
| DE | 19649071 | * | 6/1998 |
| JP | 08284518 A | * | 10/1996 |
| KR | 2019980061110 | * | 11/1998 |
| KR | 1019990038589 | * | 6/1999 |

* cited by examiner

*Primary Examiner*—Victor Batson
*Assistant Examiner*—Jeffrey O'Brien
(74) *Attorney, Agent, or Firm*—Birch, Stewart, Kolasch & Birch, LLP

(57) ABSTRACT

A door hinge apparatus of a refrigerator comprises a hinge body having a screw hole and mounted at a refrigerator body, a hinge shaft coupled to the screw hole of the hinge body so that a height thereof can be controlled by a rotation and for rotation-supporting a refrigerator door, and a selective rotation preventing unit for selectively fixing or releasing the hinge shaft. As the refrigerator door is always located at a position to sufficiently cover a freezing chamber or a cooling chamber of a refrigerator at the time of assembling or using the refrigerator door, cold air inside the freezing chamber or the cooling chamber is prevented from being leaked to outside through the refrigerator door.

15 Claims, 6 Drawing Sheets

DOOR HINGE APPARATUS OF REFRIGERATOR

BACKGROUND OF THE INVENTION

1. Field of the Invention

The present invention relates to a refrigerator, and more particularly, to a door hinge apparatus of a refrigerator capable of preventing a position of a refrigerator door from being changed by compensating the position of the refrigerator door at the time of an installation and by firmly maintaining an assembled state of the refrigerator door during an operation.

2. Description of the Conventional Art

Generally, a refrigerator stores food item such as meat, fish, vegetable, fruit, beverage, etc. as a fresh state. The refrigerator comprises a freezing chamber, a cooling chamber, a body having a vegetable chamber, etc., and a door mounted at one side of the body for opening and closing the freezing chamber and the cooling chamber.

The body comprises a refrigerating cycle system composed of a compressor, a condenser, a capillary tube, an evaporator, etc., a blowing fan for forcibly flowing cold air formed by the evaporator, and a circulation channel for guiding the cold air formed by the evaporator to be introduced into the evaporator via the freezing chamber, the cooling chamber, etc.

In the refrigerator, when a temperature of the freezing chamber or the cooling chamber becomes more than a preset temperature, the refrigerating cycle system is operated. As the refrigerating cycle system is operated, the evaporator forms cold air and the cold air circulates through the freezing chamber and the cooling chamber by the blowing fan. As the cold air circulates through the freezing chamber and the cooling chamber, temperatures of the freezing chamber, the cooling chamber, and the vegetable chamber are maintained as preset temperatures.

The refrigerator is classified as various types according to a method for circulating cold air, positions of a freezing chamber and a cooling chamber, and a construction of an evaporator.

For example, the refrigerator includes a refrigerator in which a freezing chamber is positioned at an upper side of a cooling chamber, a refrigerator in which a freezing chamber and a cooling chamber are positioned side by side, and a refrigerator in which a freezing chamber is positioned at a lower side of a cooling chamber.

In order to store food item inside the freezing chamber and the cooling chamber more longer with a fresh state, the temperatures of the cooling chamber and the freezing chamber have to be maintained as preset temperatures. Also, in order to maintain the temperatures of the freezing chamber and the cooling chamber, cold air of the freezing chamber and the cooling chamber is prevented from being leaked to outside.

The greatest reason why the cool air of the freezing chamber and the cooling chamber is leaked outwardly is due to a gap between the body and the door mounted at the body. Generally, a refrigerator door is mounted at one side of a refrigerator body by a hinge apparatus, and a leakage amount of cold air of a freezing chamber and a cooling chamber is determined according to a coupling structure between the refrigerator door and the hinge apparatus.

If cold air is much leaked from the freezing chamber and the cooling chamber, food item stored in the freezing chamber and the cooling chamber can not be maintained as a fresh state and a lot of driving time is required to maintain preset temperatures of the freezing chamber and the cooling chamber thereby to increase power consumption. Accordingly, it is an important technical task to couple the refrigerator door to the refrigerator body in order to minimize the gap between the refrigerator body and the refrigerator door.

FIG. 1 is a perspective view showing one embodiment of a refrigerator in accordance with the conventional art, and FIG. 2 is a perspective view showing a hinge apparatus coupled between a refrigerator door and a refrigerator body in accordance with the conventional art.

As shown, a hinge apparatus 300 is respectively mounted to upper and lower portions of a refrigerator body 100 having a cooling chamber (R) therein, and upper and lower portions of a door 200 are respectively coupled to the hinge apparatuses 300.

As shown in FIG. 2, the hinge apparatus comprises a hinge body 310 curved as a certain shape and having a plurality of holes 311, and a hinge shaft 320 coupled to the hinge body 310.

The hinge body 310 is curved as a vertical shape. One end of the hinge shaft 320 is caulked under a state that the hinge shaft 320 is fitted into a caulking hole (not shown) formed at one side of the hinge body 310, thereby coupling the hinge shaft 320 to the hinge body 310. The hinge shaft 320 is vertically positioned on one surface of the hinge body 310.

In the hinge apparatus 300 mounted at the upper portion of the body 100, the hinge body 310 is coupled to the refrigerator body 100 so that the hinge shaft 320 can be towards a lower direction, and the hinge body 310 is fixed by a plurality of screws (not shown).

In the hinge apparatus 300 mounted at the lower portion of the body 100, the hinge body 310 is coupled to the refrigerator body 100 so that the hinge shaft 320 can be towards an upper direction, and the hinge body 310 is fixed by a plurality of screws (not shown).

A hinge hole 201 for inserting the hinge shaft 320 is respectively formed at upper and lower surfaces of the refrigerator door 200 in the same direction.

The hinge shaft 320 of the upper hinge apparatus is inserted into the upper hinge hole 201 of the door 200, and the hinge shaft 320 of the lower hinge apparatus is inserted into the lower hinge hole 201 of the door 200. The door 200 opens and closes the cooling chamber R by making the upper and lower hinge apparatuses 300 as a shaft.

An unexplained reference numeral 400 denotes a drawer.

However, in the conventional hinge apparatus, the hinge shaft 320 is fixedly coupled to the hinge body 310 by a caulking thereby to generate an installation error or an assembly error of the hinge apparatus 300. Accordingly, when the door 200 is not precisely positioned for the body 100 in upper and lower directions, it is hard to compensate the position of the door 200 and thereby cold air of the cooling chamber R is leaked.

In order to solve the above problem, a screw thread is formed at one side of the hinge shaft 320 of the hinge apparatus, and a screw hole is respectively formed at the hinge body 310. Accordingly, the screw thread of the hinge shaft 320 can be coupled to the screw hole of the hinge body 310, and the height of the hinge shaft 320 can be controlled by rotating the hinge shaft 320.

However, in the conventional hinge apparatus, when the refrigerator door 200 is continuously opened and closed, a relative rotation force is generated between the hinge shaft 320 of the hinge body 310 and the refrigerator door 200 by a rotation of the refrigerator door 200 thereby to move the hinge shaft 320 up and down. Accordingly, the refrigerator door 200 is not smoothly operated and a gap is generated between the refrigerator body 100 and the refrigerator door 200 thereby to cause a leakage of cold air.

SUMMARY OF THE INVENTION

Therefore, an object of the present invention is to provide a door hinge apparatus of a refrigerator capable of preventing a position of a refrigerator door from being changed by compensating the position of the refrigerator door at the time of an installation and by firmly maintaining an assembled state of the refrigerator door during an operation.

To achieve these and other advantages and in accordance with the purpose of the present invention, as embodied and broadly described herein, there is provided a door hinge apparatus of a refrigerator comprising: a hinge body having a screw hole and mounted at a refrigerator body; a hinge shaft coupled to the screw hole of the hinge body so that a height thereof can be controlled by a rotation, for rotation-supporting a refrigerator door; and a selective rotation preventing unit for selectively fixing or releasing the hinge shaft.

The foregoing and other objects, features, aspects and advantages of the present invention will become more apparent from the following detailed description of the present invention when taken in conjunction with the accompanying drawings.

BRIEF DESCRIPTION OF THE DRAWINGS

The accompanying drawings, which are included to provide a further understanding of the invention and are incorporated in and constitute a part of this specification, illustrate embodiments of the invention and together with the description serve to explain the principles of the invention.

In the drawings.

DETAILED DESCRIPTION OF THE PREFERRED EMBODIMENTS

Reference will now be made in detail to the preferred embodiments of the present invention, examples of which are illustrated in the accompanying drawings.

Hereinafter, a door hinge apparatus of a refrigerator according to the present invention will be explained in more detail with reference to attached drawings.

Figure 1:
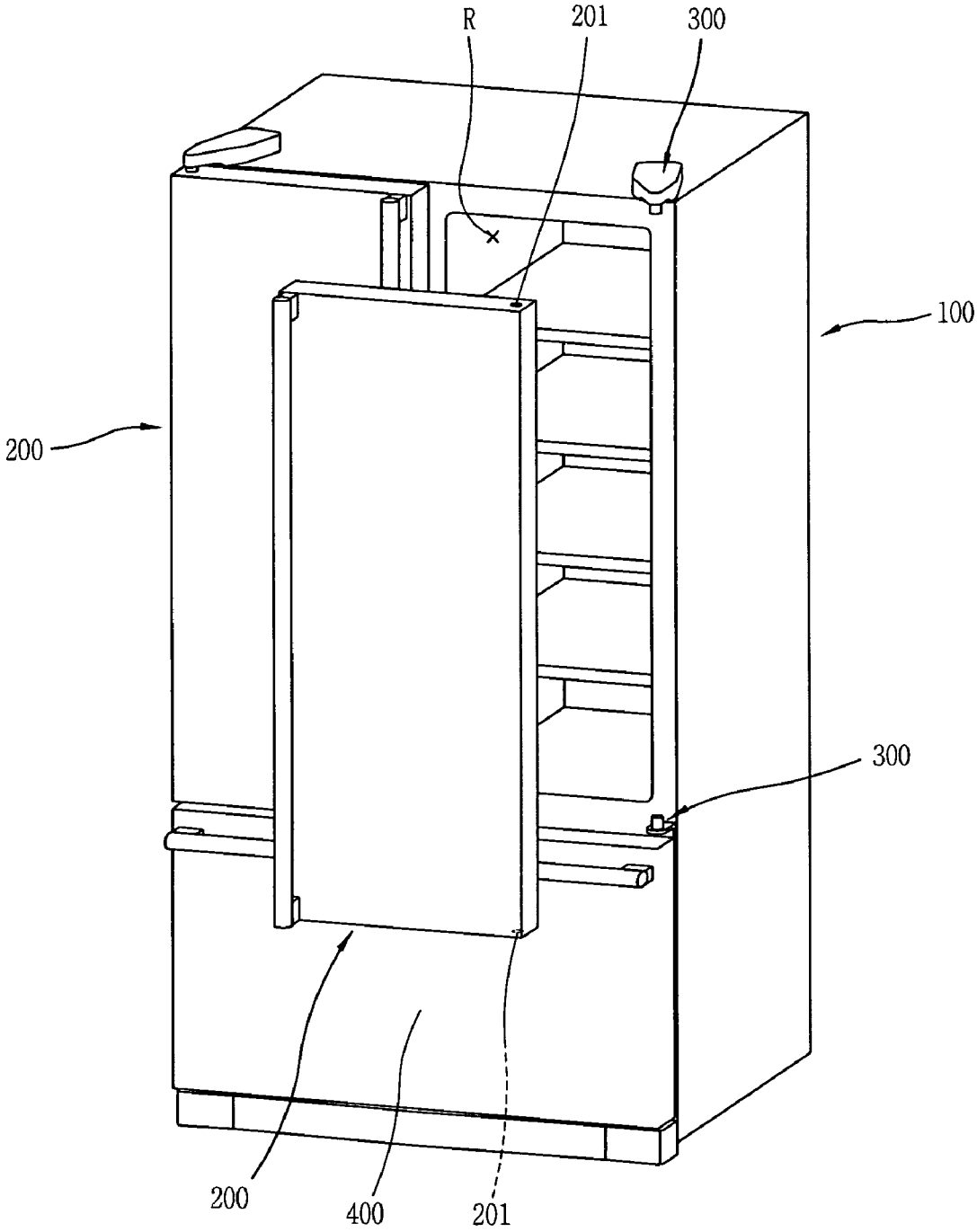
FIG. 1 CONVENTIONAL ART
FIG. 1 is a perspective view showing one embodiment of a refrigerator in accordance with the conventional art.
Figure 2:
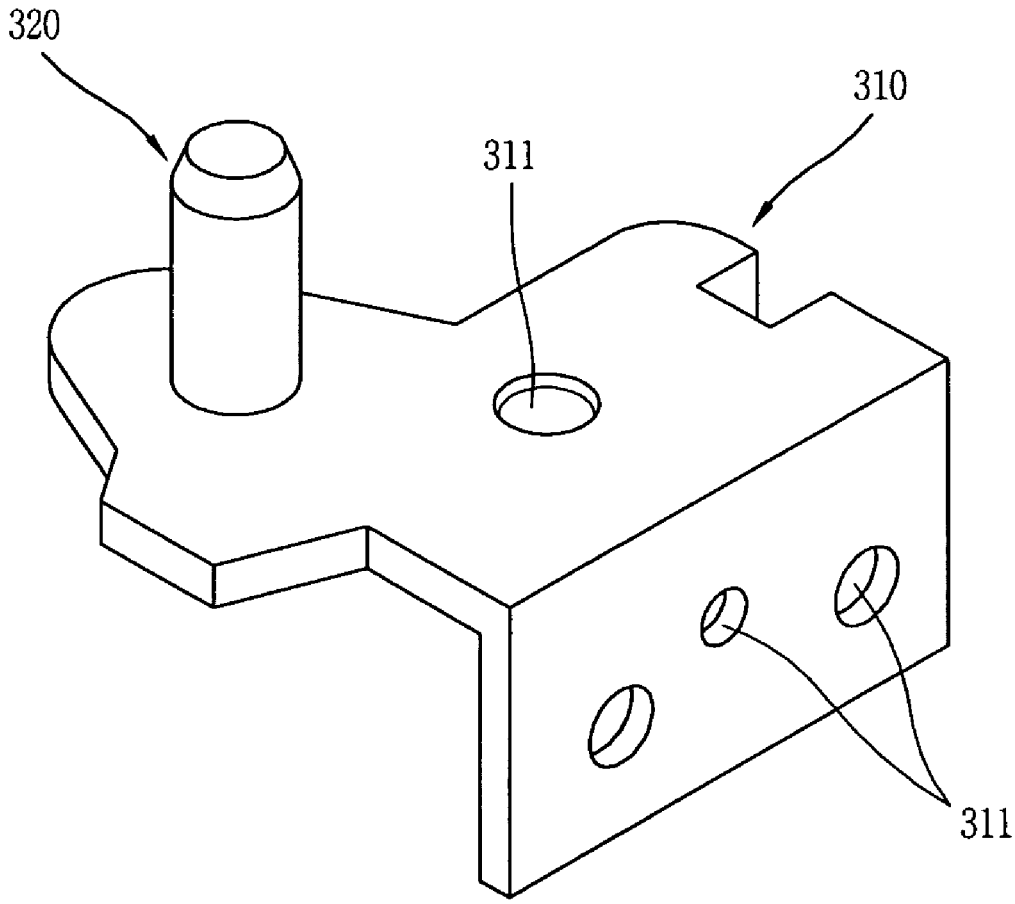
FIG. 2 CONVENTIONAL ART
FIG. 2 is a perspective view showing a door hinge apparatus of a refrigerator in accordance with the conventional art.
Figure 3:
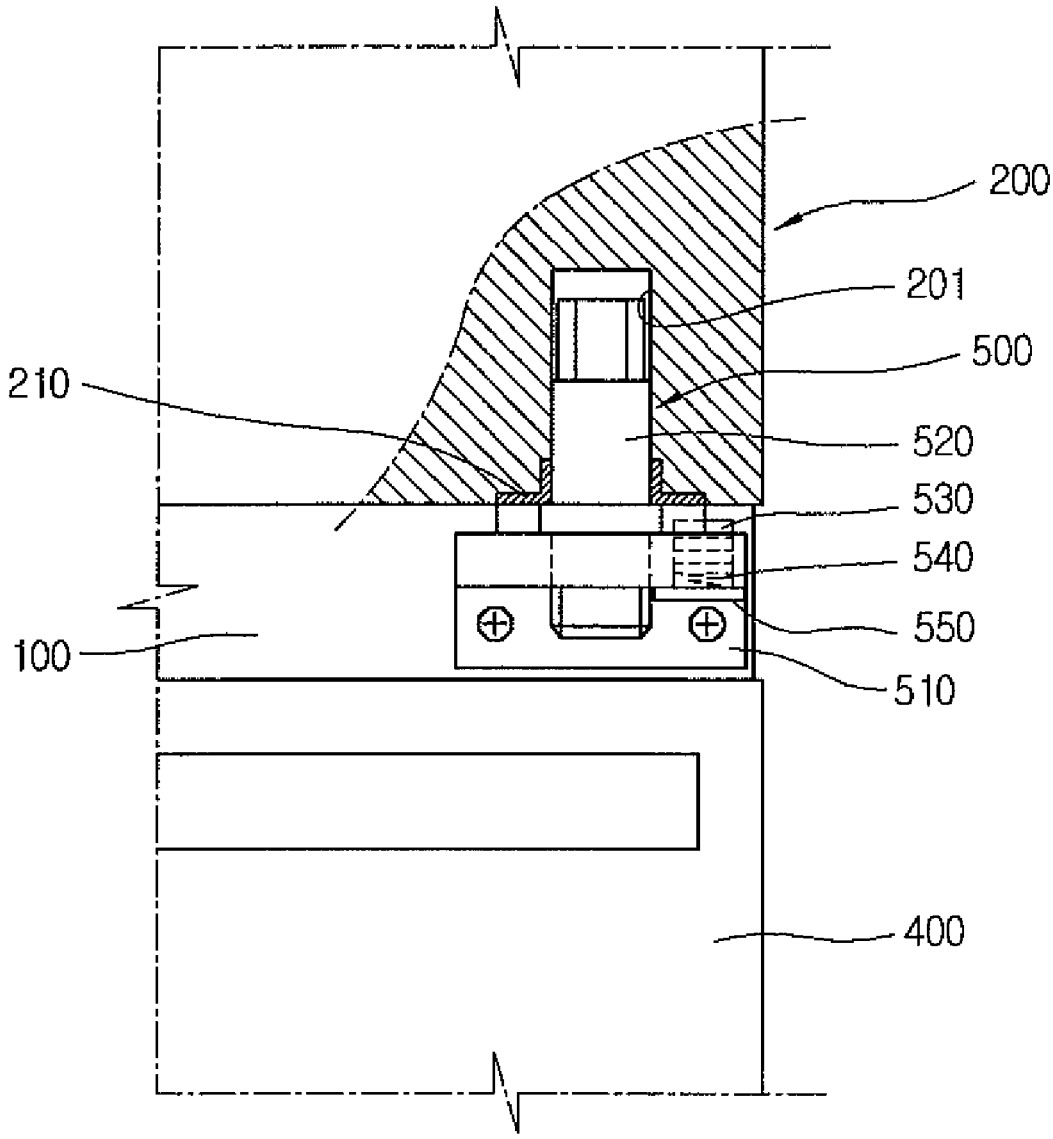
FIG. 3 is a frontal view showing a door hinge apparatus of a refrigerator according to one embodiment of the present invention.
Figure 4:
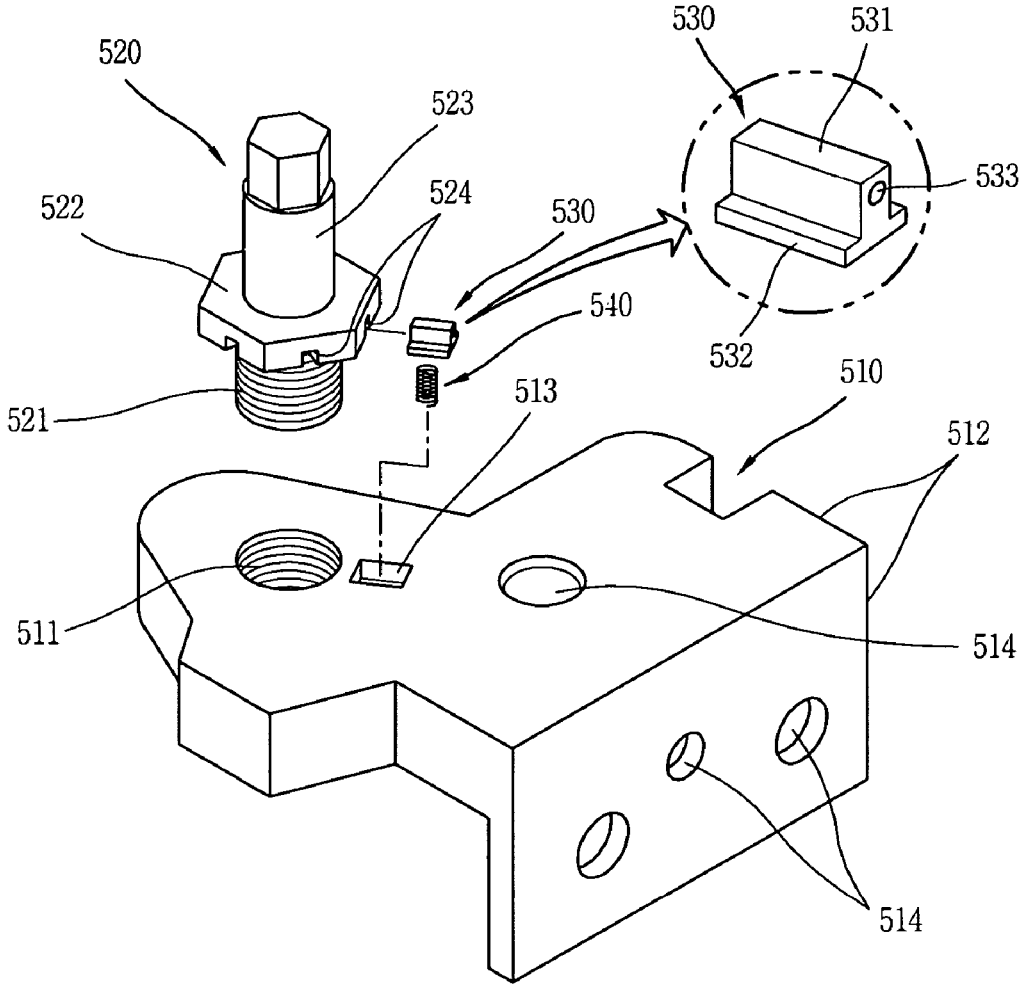
FIG. 4 is an exploded perspective view showing the door hinge apparatus of a refrigerator according to the present invention.
Figure 5:
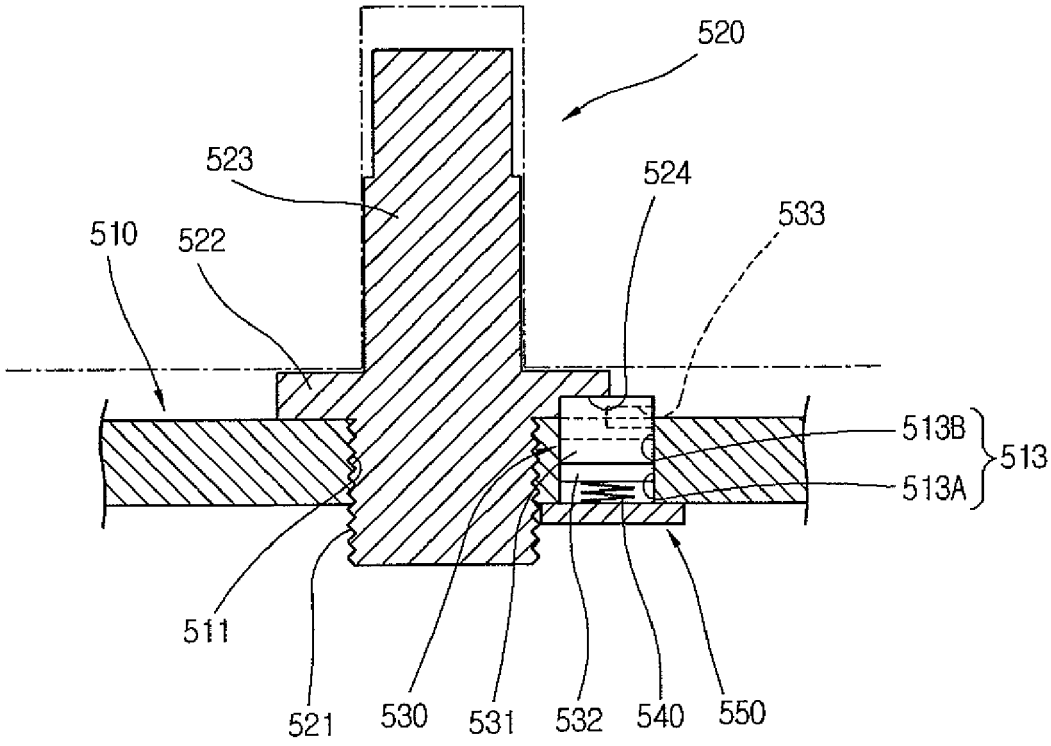
FIGS. 5 and 6 are respectively a frontal section view and a plane view showing the door hinge apparatus of a refrigerator according to the present invention.
Figure 6:
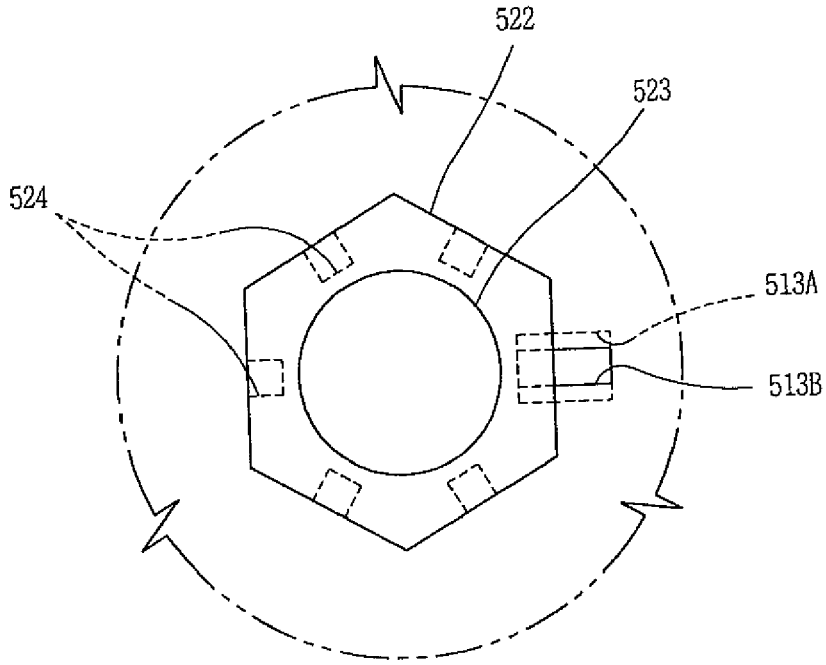

FIG. 3 is a frontal view showing a door hinge apparatus of a refrigerator according to one embodiment of the present invention, FIG. 4 is an exploded perspective view showing the door hinge apparatus of a refrigerator according to the present invention, and FIGS. 5 and 6 are respectively a frontal section view and a plane view showing the door hinge apparatus of a refrigerator according to the present invention. The same reference numerals were given to the same parts as those of the conventional art.

As shown, a door hinge apparatus 500 of a refrigerator according to the present invention is mounted at one side of a refrigerator body 100 thereby to fixedly support a refrigerator door 200.

The door hinge apparatus of a refrigerator according to the present invention comprises a hinge body 510 having a screw hole 511 and mounted at the refrigerator body 100, a hinge shaft 520 coupled to the screw hole 511 of the hinge body 510 so that a height thereof can be controlled by a rotation, for rotation-supporting the refrigerator door 200, and a selective rotation preventing unit for selectively fixing or releasing the hinge shaft 520.

The hinge body 510 comprises a body portion 512 curved as a certain shape, a screw hole 511 formed at one side of the body portion 512, a guide hole 513 formed next to the screw hole 511, and a plurality of holes 514 formed at the body portion 512.

The screw hole 511 is provided with a screw thread at an inner circumferential surface thereof.

The guide hole 513 is penetratingly formed at the body portion 512 of the hinge body 510. The guide hole 513 comprises a first hole 513A having a sectional surface of a square shape and a certain depth, and a second hole 513B connected to the first hole 513A and having a sectional surface of a square shape smaller than that of the first hole 513A and a certain depth. The first hole 513A is formed to be deeper than the second hole 513B, and the second hole 513B is positioned more highly than the first hole 513A.

The hinge shaft 520 comprises a height controlling portion 521 having a screw thread and coupled to the screw hole 511 of the hinge body 510, a stepped portion 522 extendingly formed from the height controlling portion 521 and having a sectional surface larger than that of the height controlling portion 521 and a certain length, a supporting shaft 523 extendingly formed from the stepped portion 522 and having a certain outer diameter and length, and a fixing portion 524 formed at the stepped portion 522.

Preferably, a sectional surface of the stepped portion 522 of the hinge shaft is a hexagonal shape.

The supporting shaft 523 of the hinge shaft is formed as a bar shape having a certain length, and the end thereof has a hexagonal surface. The hexagonal surface of the supporting shaft 523 is formed in order to insert an additional tool such as a spanner for rotating the hinge shaft when the hinge shaft 520 is coupled to the hinge body 510.

The fixing portion 524 of the hinge shaft is composed of a plurality of grooves formed at a lower surface of the stepped portion 522, and the grooves are formed as the same shape. Preferably, six grooves are formed to constitute the fixing portion 524, and each groove has a sectional surface of a square shape and a certain depth. Preferably, one side of the groove of the fixing portion 524 is opened towards outside of the stepped portion 522.

The selective rotation preventing unit for fixing or releasing the hinge shaft 520 is mounted at the hinge body 510.

The selective rotation preventing unit comprises a guide hole 513 formed at the hinge body 510, a stopper 530 inserted into the guide hole 513 to be movable up and down, and a spring 540 inserted into the guide hole 513 for elastically supporting the stopper 530 so that the stopper 530 can fix a part of the hinge shaft by locking.

Preferably, a supporting member 550 for supporting the spring 540 is provided at the hinge body 510. The supporting member 550 is coupled to the hinge body 510 by a plurality of screws (not shown).

The stopper 530 comprises a stopping portion 531 having a sectional surface of a square shape and a certain length, and a stepped portion 532 formed at one side of the stopping portion 531 and having a sectional area larger than that of the stopping portion 531 and a certain length.

A sectional shape and a sectional area of the stopping portion 531 of the stopper 530 correspond to those of the second hole 513B of the guide hole 513, and a sectional shape and a sectional area of the stepped portion 532 of the stopper 530 correspond to those of the first hole 513A of the guide hole 513.

Preferably, a pressing portion 533 for pressing the stopper 530 is provided at one side of the stopper 530 as an additional member. The pressing portion 533 is preferably formed as a groove shape having a certain depth at one side of the stopping portion 531.

Figure 7:
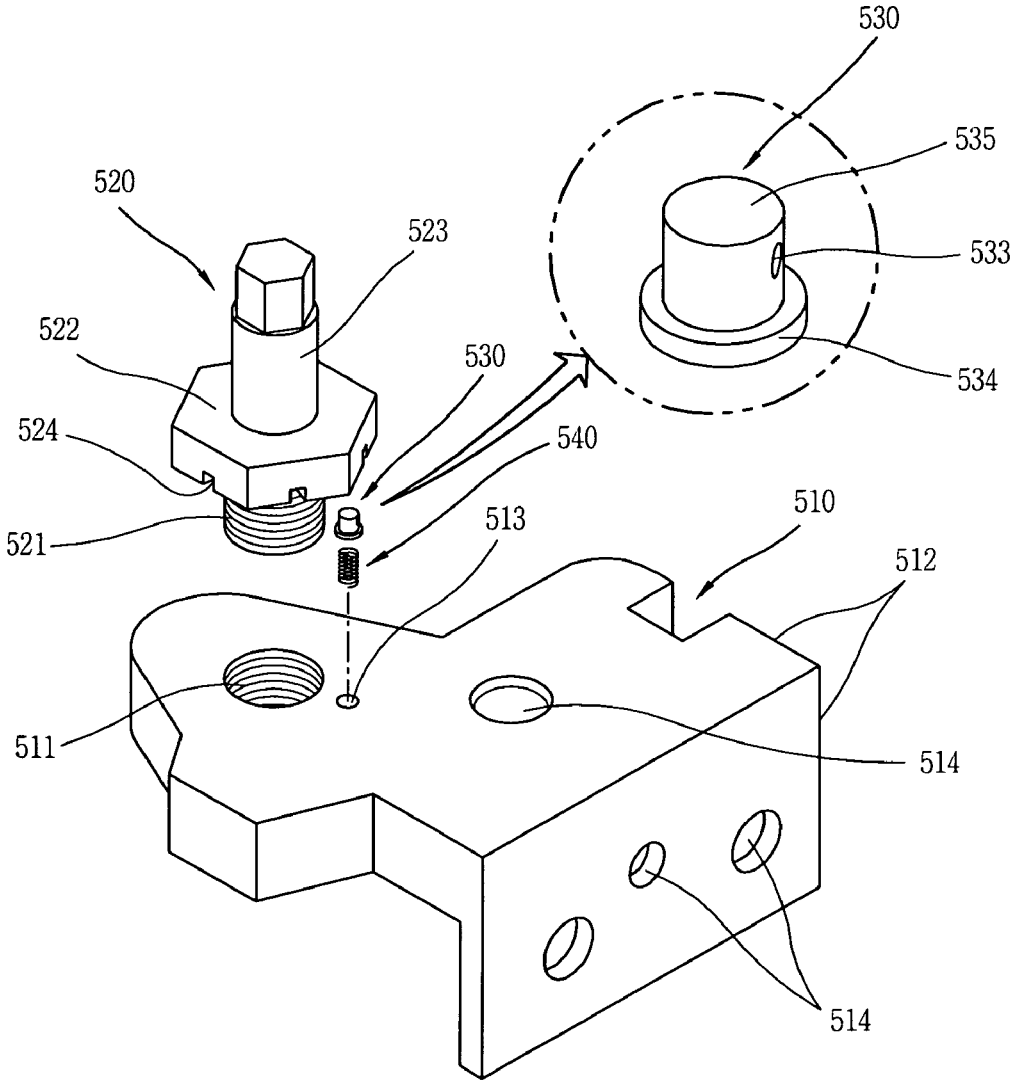
FIG. 7 is a perspective view showing a selective rotation preventing unit of the door hinge apparatus of a refrigerator according to another embodiment of the present invention.

As another modification example of the selective rotation preventing unit, as shown in FIG. 7, the stopper 530 is formed as a stepped bar shape, and the guide hole 513 for inserting the stopper 530 is formed to have a sectional surface of a circular shape corresponding to the shape of the stopper 530.

That is, the stopper 530 is composed of a first bar 534 and a second bar 535 having different diameters, and an interface between the first and second bars 534 and 535 is stepped. The pressing portion 533 is formed at the first bar 534 having a smaller diameter. The guide hole 513 is composed of a first cylindrical hole and a second cylindrical hole having different inner diameters and corresponding to the first and second bars 534 and 535. An interface between the first cylindrical hole 513 and the second cylindrical hole is stepped. An inner diameter of the first cylindrical shape is smaller than that of the second cylindrical hole.

Unexplained reference numerals 210 and 400 respectively denote a washer coupled to the door and a drawer.

Hereinafter, the operation of the door hinge apparatus of a refrigerator according to the present invention will be explained as follows.

A process for assembling components of the door hinge apparatus of a refrigerator according to the present invention will be firstly explained.

The stopper 530 is inserted into the guide hole 513 of the hinge body 510, and then the spring 540 for elastically supporting the stopper 530 is inserted into the guide hole 513. The supporting member 550 is coupled to the lower surface of the hinge body 510 by screws (not shown), thereby supporting the spring 540. The stopper 530 is protruded from the upper surface of the hinge body 510 as the spring 540 is supported.

The height controlling portion 521 of the hinge shaft 520 is coupled to the screw hole 511 of the hinge body 510. As the hinge shaft 520 is rotated, the height controlling portion 521 is moved up and down and thereby the height of the hinge shaft 520 protruded from the upper surface of the hinge body 510 is controlled. In order to control the height of the hinge shaft 520, an additional member such as a pin is inserted into the pressing portion 533 of the stopper 530 at the time of rotating the hinge shaft 520, thereby rotating the hinge shaft 520 under a state that the stopper 530 is downward pressed. When the height of the hinge shaft 520 protruded from the upper surface of the hinge body has been determined, the pressing of the stopper 530 is released thereby to insert the stopping portion 531 of the stopper 530 into the fixing portion 524 of the hinge shaft 520 and to elastically support the stopper 530 by the spring 540. As a part of the stopping portion 531 of the stopper 530 is inserted into the fixing portion 524 of the hinge shaft 520, the hinge shaft 520 is prevented from being rotated.

In order to control the height of the hinge shaft 520 protruded from the upper surface of the hinge body 510 at the time of rotating the hinge shaft 520, the stopper 530 is pressed thereby to separate the stopping portion 531 of the stopper 530 from the fixing portion 524 of the hinge shaft 520.

The hinge body 510 is mounted at the refrigerator body 100 by a plurality of coupling screws (not shown), and the coupling screws are respectively inserted into the holes 514 of the hinge body 510.

The hinge shaft 520 coupled to the hinge body 510 is respectively inserted into a hinge hole formed at one side surface of the door 200 and a hinge hole formed at another side surface of the door 200. By the two hinge shafts 520, the door 200 is rotatably fixed.

When the door 200 is not located at a preset position for covering the freezing chamber or the cooling chamber of the refrigerator, the hinge shaft 520 is rotated thereby to control the position of the door 200. As aforementioned, the hinge shaft 520 is prevented from being rotated or rotated by fixing or releasing the hinge shaft 520 by using the selective rotation preventing unit.

When the user opens or closes the freezing chamber or the cooling chamber by rotating the door 200, a relative rotation force is generated between the door 200 and the hinge shaft 520. However, the hinge shaft 520 is prevented from being rotated by the selective rotation preventing unit. Accordingly, even if the relative rotation force is applied to the hinge shaft 520, the hinge shaft 520 is not rotated.

As aforementioned, in the door hinge apparatus of a refrigerator according to the present invention, the door 200 is controlled to be precisely located at a preset position when the door 200 is to be coupled to the refrigerator body 100. Also, the rotation of the hinge shaft 520 due to a rotation force generated at the time of using the door 200 is prevented, so that the door 200 is always located at a position to sufficiently cover the freezing chamber or the cooling chamber at the time of assembling or using the door 200.

Accordingly, cold air generated from the freezing chamber or the cooling chamber of the refrigerator is prevented from being leaked to outside through the door 200, thereby storing food inside the freezing chamber and the cooling chamber more freshly and decreasing power consumption by reducing a driving time of the refrigerator.

As the present invention may be embodied in several forms without departing from the spirit or essential characteristics thereof, it should also be understood that the above-described embodiments are not limited by any of the details of the foregoing description, unless otherwise specified, but rather should be construed broadly within its spirit and scope as defined in the appended claims, and therefore all changes and modifications that fall within the metes and bounds of the claims, or equivalence of such metes and bounds are therefore intended to be embraced by the appended claims.

What is claimed is:

1. A door hinge apparatus of a refrigerator comprising:

a hinge body having a screw hole and mounted at a refrigerator body;

a hinge shaft coupled to the screw hole of the hinge body so that a height thereof can be controlled by a rotation, for rotation-supporting a refrigerator door; and a bi-directional rotation preventing unit for selectively fixing or releasing the hinge shaft, the rotation preventing unit comprising a recess located in the hinge shaft, and a projection movable into and out of the recess, wherein the hinge shaft is rotatable about a longitudinal axis so that a height of the hinge shaft can be controlled by rotation, and wherein the projection is movable in a direction generally parallel to said longitudinal axis to move into and out of the recess.

2. The apparatus of claim 1, wherein the rotation preventing unit for selectively fixing or releasing the hinge shaft is mounted at the hinge body.

3. The apparatus of claim 1, wherein the hinge shaft has a plurality of parts fixed by the rotation preventing unit.

4. The apparatus of claim 1, wherein the hinge shaft comprises:

a height controlling portion having a screw thread and coupled to the screw hole of the hinge body;

a stepped portion extendingly formed from the height controlling portion and having a sectional surface larger than that of the height controlling portion and a certain length;

a supporting shaft extendingly formed from the stepped portion to have a certain outer diameter and length, and inserted into a hinge hole of the door; and said recess is formed at the stepped portion.

5. The apparatus of claim 4, wherein a plurality of said recesses are formed at a lower surface of the stepped portion.

6. The apparatus of claim 4, wherein the stepped portion has a sectional surface of a hexagonal shape.

7. The apparatus of claim 1, wherein the rotation preventing unit comprises:

a guide hole formed at one side of the hinge body;

a stopper including said projection inserted into the guide hole to be movable up and down; and a spring inserted into the guide hole for elastically supporting the stopper so that the stopper can fix a part of the hinge shaft by locking.

8. The apparatus of claim 7, wherein the stopper is provided with a pressing portion for pressing the stopper in a direction towards the spring as an additional member at one side thereof.

9. The apparatus of claim 8, wherein the pressing portion is formed as a groove shape having a certain depth.

10. The apparatus of claim 7, wherein the hinge body is provided with a supporting member for supporting the spring.

11. The apparatus of claim 7, wherein the stopper comprises:

a first bar having a sectional surface of a circular shape and a certain length; and a second bar extendingly formed from one side of the first bar and having a sectional surface larger than that of the first bar and a certain length.

12. The apparatus of claim 1, wherein the recess comprises a notch in a surface of the hinge shaft.

13. A door hinge apparatus of a refrigerator comprising:

a hinge body having a screw hole and mounted at a refrigerator body;

a hinge shaft coupled to the screw hole of the hinge body so that a height thereof can be controlled by a rotation, for rotation-supporting a refrigerator door; and a bi-directional rotation preventing unit for selectively fixing or releasing the hinge shaft, wherein the rotation preventing unit comprises:

a guide hole formed at one side of the hinge body;

a stopper inserted into the guide hole to be movable up and down; and a spring inserted into the guide hole for elastically supporting the stopper so that the stopper can fix a part of the hinge shaft by locking, and wherein the stopper comprises:

a stopping portion having a sectional surface of a square shape and a certain length; and a stepped portion extendingly formed from one side of the stopping portion and having a sectional area larger than that of the stopping portion and a certain length, and the guide hole comprises:

a first hole having a sectional shape corresponding to that of the stepped portion and a certain depth; and a second hole connected to the first hole and having a sectional shape corresponding to that of the stopping portion.

14. The apparatus of claim 13, wherein the depth of the first hole is deeper than that of the second hole.

15. A door hinge apparatus of a refrigerator comprising:

a hinge body having a screw hole and mounted at a refrigerator body;

a hinge shaft coupled to the screw hole of the hinge body so that a height thereof can be controlled by a rotation, for rotation-supporting a refrigerator door; and a bi-directional rotation preventing unit for selectively fixing or releasing the hinge shaft, the rotation preventing unit comprising an aperture located at the hinge shaft, and a stopper located at the hinge body and movable with respect thereto to move into and out of the aperture, wherein the hinge shaft is rotatable about a longitudinal axis so that a height of the hinge shaft can be controlled by rotation, and wherein the stopper is movable in a direction generally parallel to said longitudinal axis to move into and out of the aperture.

* * * * *